United States Patent [19]

Wurst et al.

[11] 4,315,250

[45] Feb. 9, 1982

[54] CONNECTION ARRANGEMENT FOR SELECTION AND DISPLAY SYSTEM

[75] Inventors: John W. Wurst, Dover; Howard L. Beckerman, Middletown, both of N.J.

[73] Assignee: The Singer Company, Stamford, Conn.

[21] Appl. No.: 102,289

[22] Filed: Dec. 10, 1979

[51] Int. Cl.[3] ..... G08B 5/00

[52] U.S. Cl. ..... 340/286 R; 340/782

[58] Field of Search ..... 340/147 R, 311, 780, 340/782, 286 R

[56] References Cited

U.S. PATENT DOCUMENTS 3,594,774 7/1971 Dawson ..... 340/286 R 3,944,972 3/1976 Chandler ..... 340/286

*Primary Examiner*—Harold I. Pitts

*Attorney, Agent, or Firm*—David L. Davis; Robert E. Smith; Edward L. Bell

[57] ABSTRACT

An arrangement for utilizing a single lead for communication and control between a controller and a switch-indicator pair. The switch and indicator are connected and the single lead is connected at a junction point of the switch and the control input of the indicator so that when the switch is closed the lead carries thereon a signal indicative of switch closure and the controller may utilize this same lead to provide a signal for controlling the energization of the indicator.

5 Claims, 4 Drawing Figures

Fig.1
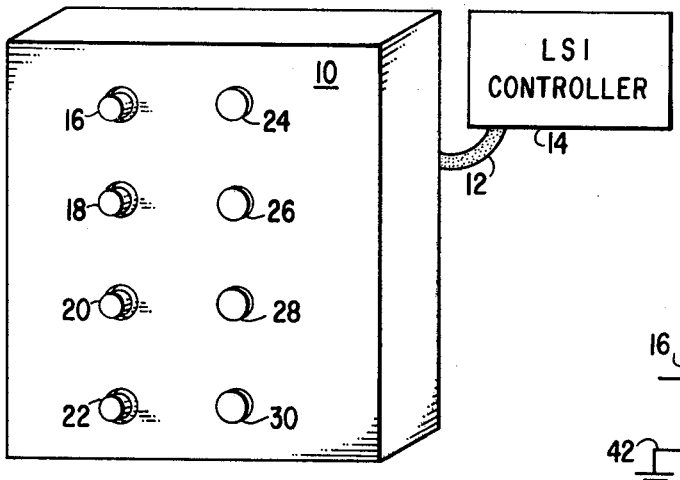
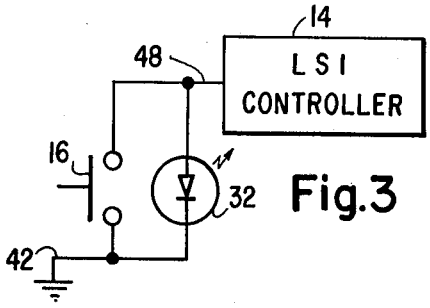
Fig.3
Fig.2
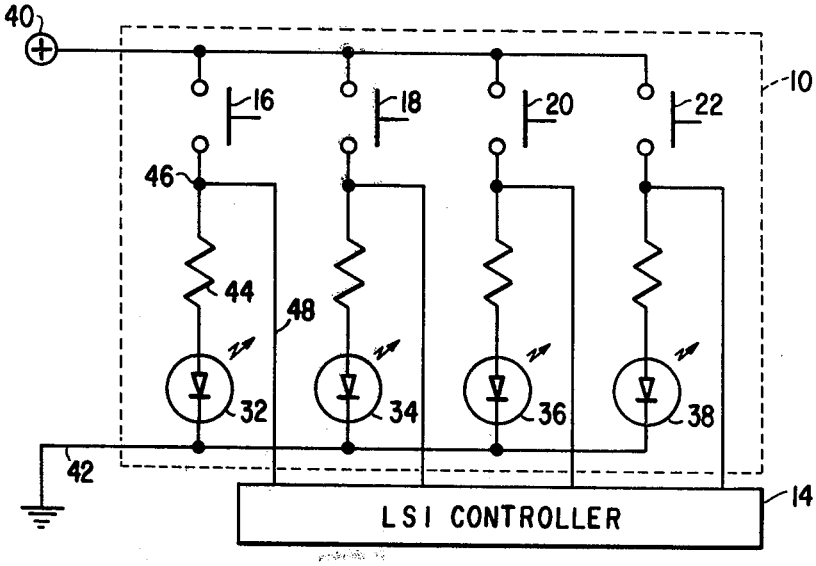
Fig.4
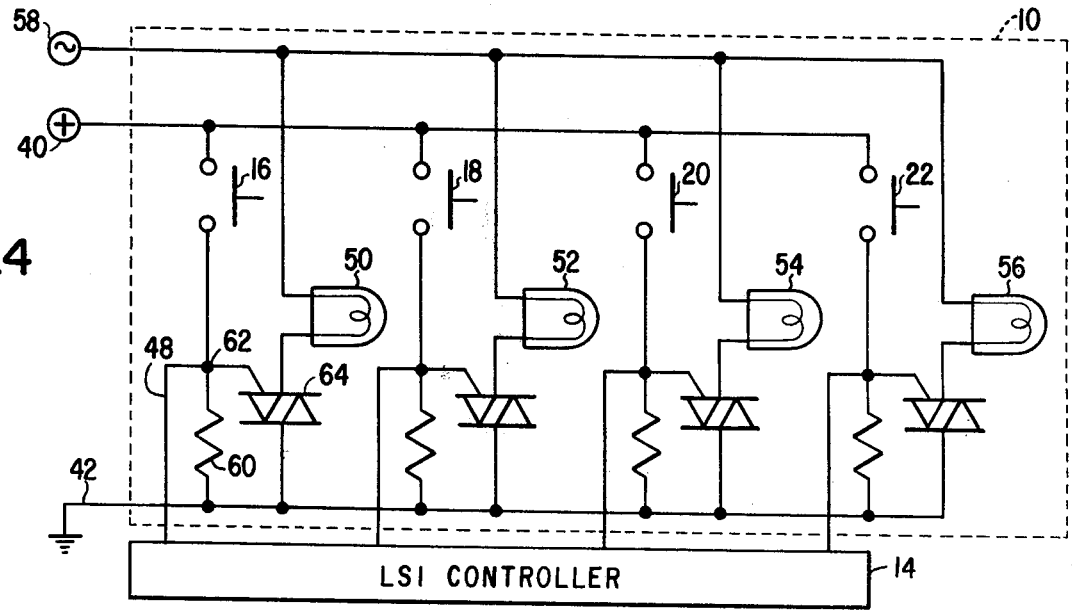

CONNECTION ARRANGEMENT FOR SELECTION AND DISPLAY SYSTEM

BACKGROUND OF THE INVENTION

This invention relates to selection and display systems and, more particularly, to an arrangement for minimizing the number of leads between such a system and a system controller.

The present invention is particularly concerned with a system capable of performing a plurality of functions, each of which is operator selectable by the actuation of a switch dedicated to that function, the system providing visual feedback to the operator of that function selection by controlling the energization of an indicator associated therewith. Prior art controller circuitry typically required an input lead from the switch and a separate output lead to the indicator. With the advent of integrated circuits for use as system controllers, the number of connections between an integrated circuit chip and the outside world becomes a serious design criterion because of the limited number of input/output terminals available on the integrated circuit chip. It is therefore a desirable objective to minimize the number of connections between a selection and display arrangement and an integrated circuit controller. In the past, there have been many proposals for limiting the number of connections. These proposals typically involve a first matrix array of the switches and a second matrix array of the indicators. However, such an arrangement is not efficient when a relatively small number of switches and indicators are used. For example, in a system having nine switches and nine corresponding indicators, the switches being in a $3\times3$ matrix array and the indicators also being in a $3\times3$ matrix array, a total of 12 leads are required.

It is therefore an object of this invention to minimize the number of connection leads between a selection and display arrangement and a system controller.

It is another object of this invention to provide a connection arrangement for a selection and display system which utilizes only a single lead for each associated pair of switches and indicators.

SUMMARY OF THE INVENTION

The foregoing and additional objects are attained in accordance with the principles of this invention by connecting each associated pair of switches and indicators between two potential levels and connecting a junction point between the pair to a single input/output terminal of the system controller.

BRIEF DESCRIPTION OF THE DRAWINGS

The foregoing will be more readily apparent upon reading the following description in conjunction with the drawings wherein:

FIG. 1 shows in diagrammatic form a system in which the principles of this invention may be applied;

FIG. 2 is a schematic circuit diagram of a first embodiment of an arrangement constructed in accordance with the principles of this invention;

FIG. 3 shows an alternate arrangement of elements from that shown in FIG. 2; and FIG. 4 is a schematic circuit diagram of another embodiment of an arrangement constructed in accordance with the principles of this invention.

DETAILED DESCRIPTION

Referring now to the drawings, wherein like elements in different figures thereof have the same reference character applied thereto, FIG. 1 diagrammatically shows a selection and display panel 10 connected via a cable 12 to a system controller 14, illustratively a large scale integrated (LSI) circuit chip. For purposes of illustration, the system shown in FIG. 1 will be considered to have the capability of four operator selectable functions. Accordingly, the selection and display panel 10 includes four operator actuable switching elements, illustratively the push buttons 16, 18, 20 and 22. Associated one each with the switching elements 16, 18, 20 and 22 is a plurality of indicating elements 24, 26, 28 and 30. Although not shown in FIG. 1, a plurality of graphic indicia corresponding to the four selectable functions may be provided on the face of the selection and display panel 10 to enable the operator to know which of the switches and indicators corresponds to the various functions. In operation, the operator would select a function to be performed by the system and depress the corresponding one of the push buttons 16, 18, 20, 22. A signal to the controller 14 would then be transmitted via the cable 12 and the controller 14 would provide another signal via the cable 12 to control the energization of the appropriate one of the indicating elements 24, 26, 28, 30. An illustrative environment in which such a system finds practical application is an electronically controlled sewing machine, such as that disclosed in U.S. Pat. No. 3,872,808, wherein operation of one of the push buttons 16, 18, 20, 22, enables a particular pattern to be sewn until a different one of the push buttons 16, 18, 20, 22, is operated.

Referring now to FIG. 2, shown therein is a schematic circuit diagram of a first embodiment constructed in accordance with the principles of this invention wherein a single line is utilized for communication between the selection and display panel 10 and the controller 14 for each associated pair of switching and indicating elements. In the embodiment shown in FIG. 2, the indicating elements comprise a plurality of light emitting diodes (LED's) 32, 34, 36, 38, associated with, respectively, the push buttons 16, 18, 20, 22. Referring specifically to the switch-indicator pair 16, 32, the first side of the switch 16 is connected to a voltage source 40 and the first side of the LED 32 is connected to ground lead 42. The second side of the switch 16 is connected to the second side of the LED 32, which acts as its control input, through a current limiting resistor 44. The junction point 46 between the resistor 44 and the switch 16 is connected via the lead 48 to the controller 14. The lead 48 functions as the only communication lead between the switch-indicator pair 16, 32 and the controller 14. With the switch 16 in its normally open state, the lead 48 has a low voltage thereon. When the switch 16 is momentarily closed due to its actuation by an operator, a conductive path is provided from the source 40 to both energize the LED 32 and provide a signal over the lead 48 to the controller 14. The controller 14 is provided with internal driving circuitry so that when it recognizes the closure of the switch 16, a positive output voltage can be applied to the lead 48 to subsequently maintain the LED 32 energized until such time as activation of one of the other switches 18, 20 or 22 provides a signal indicative of the operator's desire to change the functioning of the system.

FIG. 3 shows an alternate arrangement of the switch-indicator pair 16, 32 from that shown in FIG. 2. In FIG. 3, the switch 16 and the LED 32 are connected in parallel between the controller 14 and the ground lead 42, via the communication lead 48. A practical implementation of this would be to have the controller 14 turn on all the LED's for a short period of time which would be visually imperceptible and then scan all the communication leads to determine which switch is activated. The LED's would then all be turned off except for the one associated with the activated switch. The controller 14 would then maintain only that LED energized until the next scanning cycle when all the LED's are turned on.

Referring now to FIG. 4, shown therein is another embodiment of an arrangement constructed in accordance with the principles of this invention. In the arrangement shown in FIG. 4, each of the push button switches 16, 18, 20, 22 is associated with a respective incandescent lamp 50, 52, 54, 56. The incandescent lamps 50, 52, 54, 56 are driven from an AC source 58 while the signalling to the controller 14 is achieved from a DC source 40. Referring now to the switch-indicator pair 16, 50, the switch 16 has a first side thereof connected to the voltage source 40 and a second side connected to a common terminal, or ground lead, 42 through a pull down resistor 60. The junction 62 between the switch 16 and the resistor 60 is connected to the controller 14 via the lead 48. The incandescent lamp 50 has one side connected to the AC source 58 and its other side connected to the ground lead 42 through the conductive path of a triac 64, the control terminal of which is connected to the junction point 62. Thus, when an operator actuates the push button switch 16, a path is provided from the voltage source 40 to the controller 14 via the lead 48 to signal the controller 14 that the switch 16 has been actuated. At the same time, this voltage is also applied to the control terminal of the triac 64 to cause the triac 64 to conduct and provide a conductive path from the AC source 58 through the lamp 50, lighting the lamp 50. When the controller 14 recognizes that the push button 16 has been actuated, due to the signal being applied to the lead 48, the controller 14 applies a positive voltage signal to the lead 48 to subsequently maintain the triac 64 conductive so that the lamp 50 remains energized. At such time as the operator desires to change the functioning of the system and activates one of the other push button switches 18, 20 or 22, the controller 14 removes the positive voltage signal from the lead 48. The control terminal of the triac 64 is then pulled to ground through the resistor 60 and the triac 64 becomes nonconductive, extinguishing the lamp 50.

Accordingly, there have been disclosed arrangements for utilizing a single lead to provide communication and control between a controller and a switch-indicator pair. It is understood that the above-described embodiments are merely illustrative of the application of the principles of this invention. Numerous other embodiments may be devised by those skilled in the art without departing from the spirit and scope of this invention, as defined by the appended claims.

I claim:

1. In a system of the type having an operator actuable switching element, an indicating element having a control input associated with said switching element and a controller responsive to actuation of said switching element for performing a function associated with said switching element and for controlling the energization of said indicating element, an arrangement for utilizing only a single lead connected to said controller for the pair of switching and indicating elements for signalling the controller when said switching element is actuated and for controlling the subsequent energization of the associated indicating element, said arrangement comprising:

first means for connecting a first side of said switching element to a first level of potential;

second means for connecting a first side of said indicating element to a second potential level; and third means for connecting the second side of said switching element and the control input of said indicating element to said single lead.

2. The arrangement according to claim 1 wherein the first and second potential levels are different and the indicating element is a two terminal device connected in series with the switching element.

3. The arrangement according to claim 1 wherein the first and second potential levels are the same and the indicating element is a two terminal device connected in parallel with the switching element.

4. In a system of the type having a plurality of operator actuable switching elements, a plurality of indicating elements each having a control input and each associated with a corresponding one of said switching elements and a controller responsive to actuation of a selected one of said switching elements for performing a function associated with the selected switching element and for controlling the energization of the indicating element associated with said selected switching element, an arrangement for utilizing only a single lead connected to said controller for each of the pairs of switching and indicating elements for signalling the controller when a switching element is actuated and for controlling the energization of the associated indicating element, said arrangement comprising:

first means for connecting a first side of each of said switching elements to a first level of potential;

second means for connecting a first side of each of said indicating elements to a second potential level; and third means for connecting the second side of each of said switching elements and the control input of the associated indicating element to said single lead associated with the associated pair.

5. A selection and display arrangement for connection to a system controller comprising:

a first power supply;

a second power supply;

a common terminal;

a plurality of indicating elements connected between said first power supply and said common terminal;

a plurality of operator actuable switch elements connected between said second power supply and said common terminal, each of said switch elements being associated with a respective one of said indicating elements;

a plurality of resistive elements each serially connected between a respective switch element and said common terminal;

a plurality of controllable switching members each having a control input and a conductive path, the conductivity of which is controllable in accordance with voltage signals applied to the control input, each of the controllable switching members being associated with a respective one of the indicating elements and having its conductive path in series between the respective indicating element and the common terminal;

means for connecting the control input of each of the controllable switching members to the junction between the associated switch and resistive elements; and means for connecting each of said junctions individually to said system controller.

* * * * *